United States Patent [19]

Stocking et al.

[11] Patent Number: 5,004,302

[45] Date of Patent: Apr. 2, 1991

[54] SHELF SUPPORT SYSTEM FOR SPLIT CANTILEVER SHELVES

[75] Inventors: George E. Stocking; Richard A. Stich; John K. Besore; Clarence W. Denham, all of Louisville, Ky.

[73] Assignee: General Electric Company, Louisville, Ky.

[21] Appl. No.: 167,701

[22] Filed: Mar. 14, 1988

[51] Int. Cl.[5] ..... A47B 81/00

[52] U.S. Cl. ..... 312/214; 108/107

[58] Field of Search ..... 312/306, 236, 214; 211/187; 108/106, 107, 111, 108

[56] References Cited

U.S. PATENT DOCUMENTS

| | | | |
|---|---|---|---|
| 3,173,386 | 3/1965 | Magers | 108/108 |
| 3,316,044 | 4/1967 | Carbary | 108/106 |
| 3,730,108 | 5/1973 | Stroh | 108/108 |
| 3,797,903 | 3/1974 | Travlsen | 312/214 X |
| 3,885,846 | 5/1975 | Chuang et al. | 312/306 |
| 3,986,758 | 10/1976 | Heaney | 312/236 |
| 4,250,815 | 2/1981 | Swanson | 108/108 |
| 4,368,675 | 1/1983 | Propst et al. | 211/187 X |
| 4,519,511 | 5/1985 | Mendenhall | 211/187 |

*Primary Examiner*—Joseph Falk

*Attorney, Agent, or Firm*—Radford M. Reams; H. Neil Houser

[57] ABSTRACT

A refrigerator freezer compartment has an evaporator forward of its rear wall for maintaining the freezer compartment at the desired temperature with a cover forward of the evaporator to define the rear of the freezer compartment within which food may be stored. A side ladder is attached to each side wall of the freezer compartment. A horizontal bar extends between the bottoms of the two side ladders to which it is attached and is secured to the bottom of a center ladder. The upper end of the center ladder may be supported within a nipple supported by the top wall of the freezer compartment or secured to a horizontal bar extending between the tops of the two side ladders and secured thereto. Each of the side ladders and the center ladder has a column of rectangular shaped slots to receive portions of an adjustable shelf so that one shelf may be mounted between one of the side ladders and the center ladder and another shelf may be mounted between the other side ladder and the center ladder. This insures alignment of all of the slots in the side ladders and the center ladder.

20 Claims, 5 Drawing Sheets

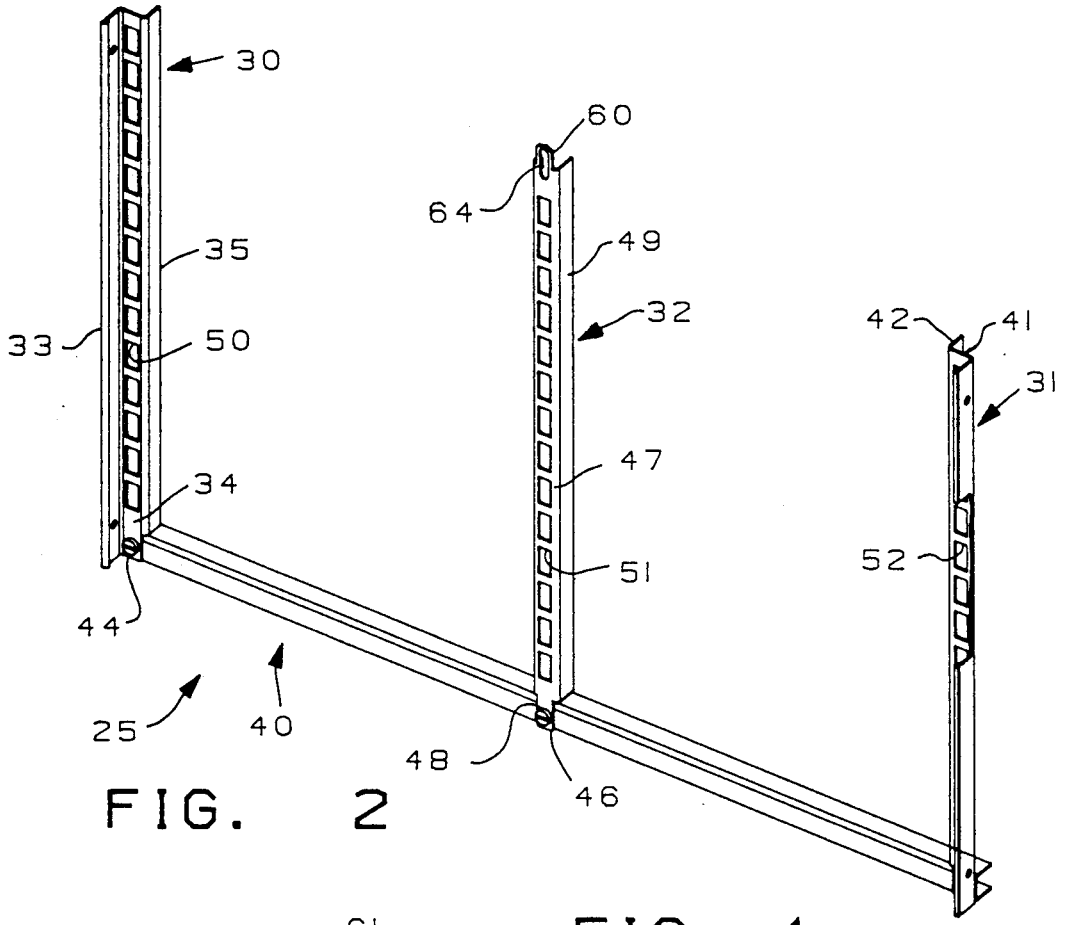
FIG. 2
FIG. 3
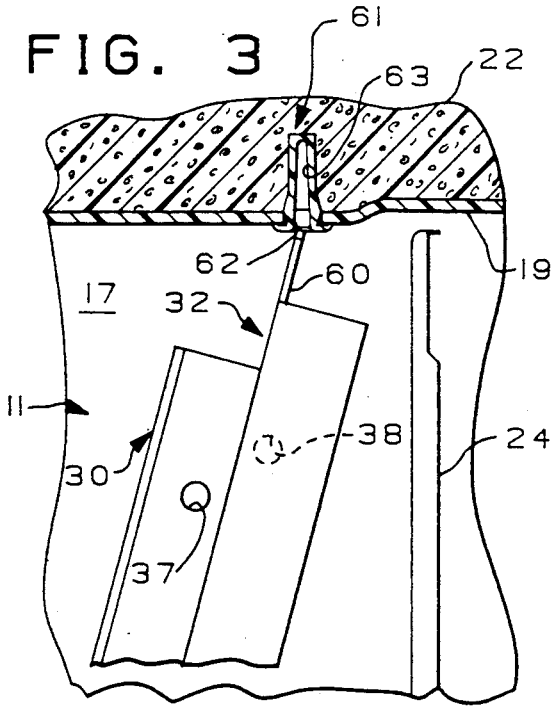
FIG. 4
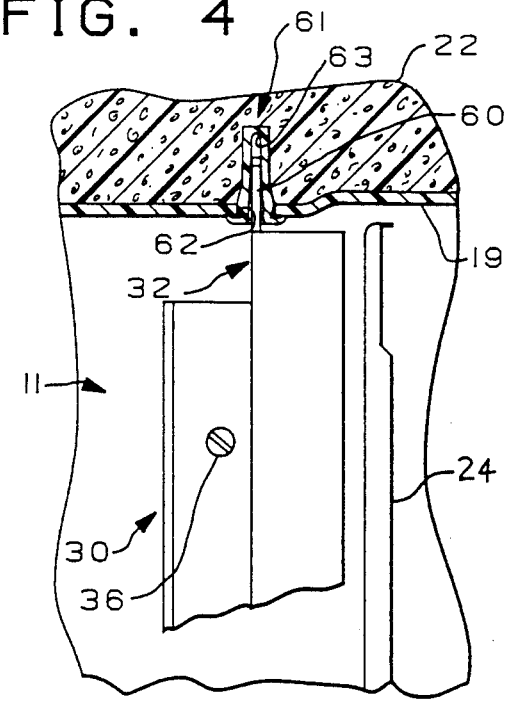

SHELF SUPPORT SYSTEM FOR SPLIT CANTILEVER SHELVES

FIELD OF THE INVENTION

This invention relates to a shelf support system for a freezer compartment of a refrigerator and, more particularly, to a shelf support system for a freezer compartment of a refrigerator for supporting split cantilever shelves.

BACKGROUND OF THE INVENTION

A freezer compartment of a refrigerator has an evaporator in its rear portion with a cover in front of the evaporator as shown in U.S. Pat. No. 4,509,335 to Griffin et al, for example. The cover is spaced from the top wall of the freezer compartment so that cold air may be circulated from the evaporator into the freezer compartment forward of the cover. Thus, the evaporator cover is not a structural support member.

Accordingly, the evaporator cover of the aforesaid Griffin et al patent cannot have any shelf support mounted thereon. As a result, shelves have only previously been supported by supports attached to the side walls of the freezer compartment.

For example, a side ladder, which has slots to receive portions of a shelf, would be mounted on each of the side walls of the freezer compartment. This has required the shelf to extend the entire width of the freezer compartment. When a portion of the freezer compartment is occupied by an ice maker, for example, utilization of adjustable shelves has been very limited in that they could be disposed in only that portion of the freezer compartment beneath the bottom of the ice maker.

The shelf support system of the present invention is capable of enabling split cantilever shelves to be utilized in the freezer compartment of a refrigerator. Thus, adjustable shelves can be disposed throughout the portion of the freezer compartment having no ice maker There also can be at least one adjustable shelf in the portion of the freezer compartment beneath the ice maker.

To utilize split cantilever shelves within the freezer compartment, it is necessary to provide a center ladder, which has slots to receive portions of a shelf, to support one portion of each shelf. That is, any shelf in the portion of the freezer compartment having no ice maker would be supported by one of the side ladders and the center ladder and any shelf beneath the ice maker would be supported by the other side ladder and the center ladder. It should be understood that the shelf support system also is utilized in a freezer compartment having no ice maker.

The shelf support system of the present invention utilizes a unique support arrangement for the center ladder, which is disposed adjacent the evaporator cover. Notwithstanding that the evaporator cover is not a structural support member, the center ladder is positively supported adjacent thereto.

The shelf support system of the present invention also provides alignment of the slots in the center ladder with the slots in each of the side ladders. Thus, the split cantilever shelves may be easily supported by the shelf support system of the present invention.

SUMMARY OF THE INVENTION

The shelf support system of the present invention includes a side ladder attached to each side wall of the freezer compartment of the refrigerator adjacent the evaporator cover. Horizontal support means extends between the bottoms of the two side ladders to which it is attached and supports the bottom of a center ladder. The upper end of the center ladder may be disposed in a socket in the top wall of the freezer compartment to precisely locate and support the center ladder or the top of the center ladder may be attached to horizontal support means, which extends between and is connected to the top of each of the side ladders.

This arrangement aligns the slots in the side ladders and the center ladder in the same plane. As a result, one split cantilever shelf may be supported by one of the side ladders and the center ladder and another split cantilever shelf may be supported by the other side ladder and the center ladder.

Thus, this shelf support system enables an ice maker, for example, to be disposed in one portion of the freezer compartment. With the center ladder disposed adjacent the inner side of the ice maker, the center ladder and one of the side ladders have split cantilever shelves disposed therebetween in any location between the top and bottom walls of the freezer compartment. The other side ladder and the center ladder may support a shelf or shelves beneath the ice maker. These would usually be shelves of a narrower width than those not supported beneath the ice maker.

An object of this invention is to provide a shelf support system for split cantilever shelves.

Other objects of this invention will be readily perceived from the following description, claims, and drawings.

BRIEF DESCRIPTION OF THE DRAWINGS

The attached drawings illustrate preferred embodiments of the invention, in which:

FIG. 2 is a isometric view of the shelf support system of FIG. 1;

FIG. 3 is an enlarged fragmentary side elevational view, partly in section, of a portion of the freezer compartment of FIG. 1 and showing an upper portion of a center ladder of the shelf support prior to its support within a top wall of the freezer compartment;

FIG. 4 is an enlarged fragmentary side elevational view, partly in section, of the portion of the freezer compartment shown in FIG. 3 and showing the upper portion of the center ladder of the shelf support system supported in the top wall of the freezer compartment;

DESCRIPTION OF THE PREFERRED EMBODIMENTS

Figure 1:
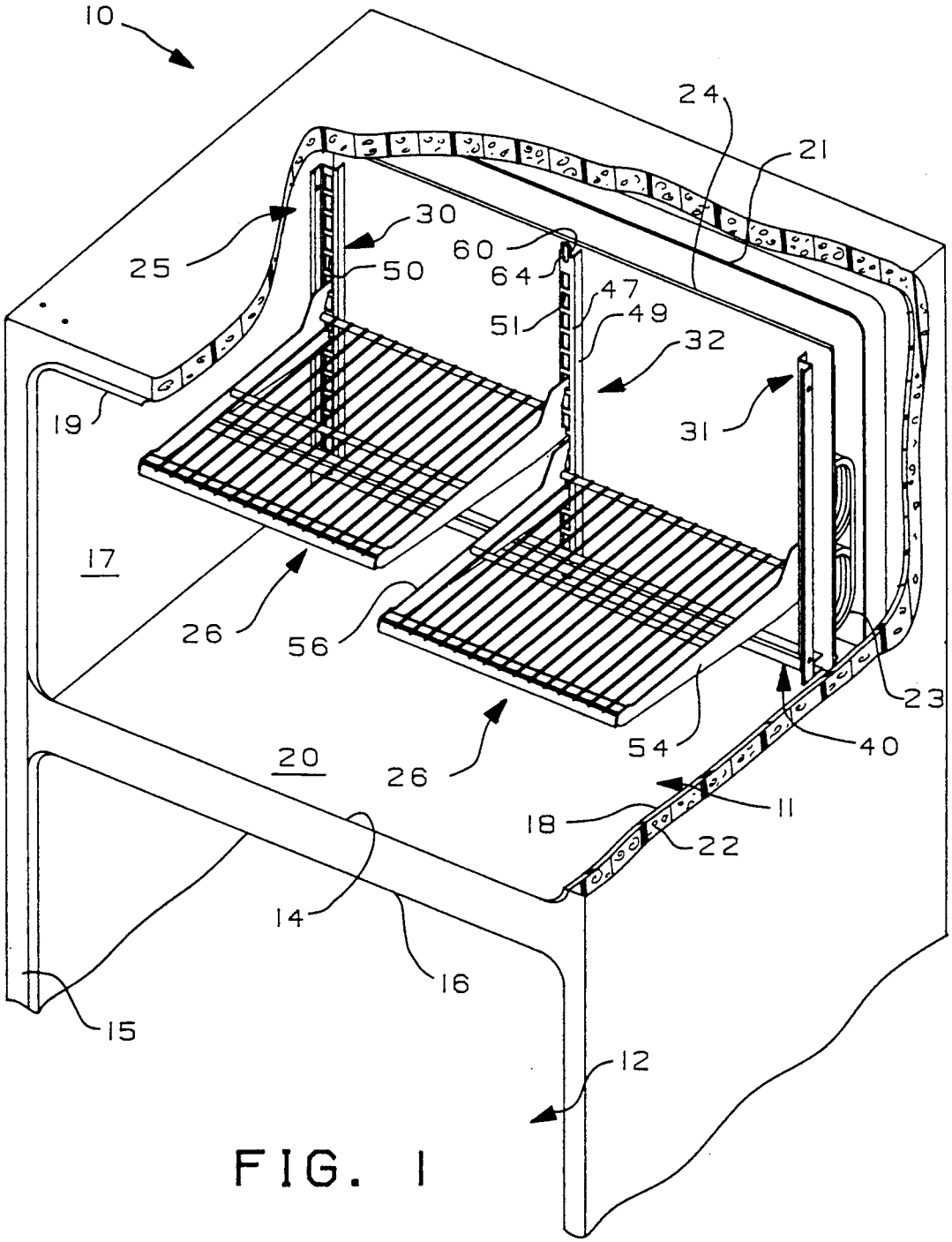
FIG. 1 is a fragmentary isometric view, partly in section, of a portion of a two compartment refrigerator cabinet having a shelf support system of the present invention mounted in its freezer compartment.

Referring to the drawings and particularly FIG. 1, there is shown a refrigerator cabinet 10 having a freezer compartment 11 and a fresh food cooling compartment 12. The freezer compartment 11 has its access opening 14 in a front wall 15 of the refrigerator cabinet 10 closed by a hinged door (not shown). The fresh food cooling compartment 12 has its access opening 16 in the front wall 15 closed by a hinged door (not shown).

The freezer compartment 11 includes a pair of substantially parallel side walls 17 and 18 disposed substantially perpendicular to a top wall 19, a bottom wall 20, and a rear wall 21 of the freezer compartment 11. Foam insulation material 22 is disposed exterior of each of the side walls 17 and 18, the top wall 19, the bottom wall 20, and the rear wall 21 of the freezer compartment 11.

Evaporator coils 23 of a refrigerant system are disposed behind a cover 24 in a manner similar to that shown in the aforesaid Griffin et al patent, for example, which is incorporated by reference. As shown in FIGS. 3 and 4, the cover 24 has its top spaced from the bottom of the top wall 19 of the freezer compartment 11 to enable air flow therebetween. There also is air flow return through a louver (not shown) in the bottom of the cover 24, for example.

The freezer compartment 11 (see FIG. 1) has a shelf support system 25 supported therein forward of the cover 24 to adjustably support split cantilever shelves 26. The shelf support system 25 includes a pair of substantially parallel Z-shaped side ladders 30 and 31 having a center ladder 32 therebetween.

Figure 6:
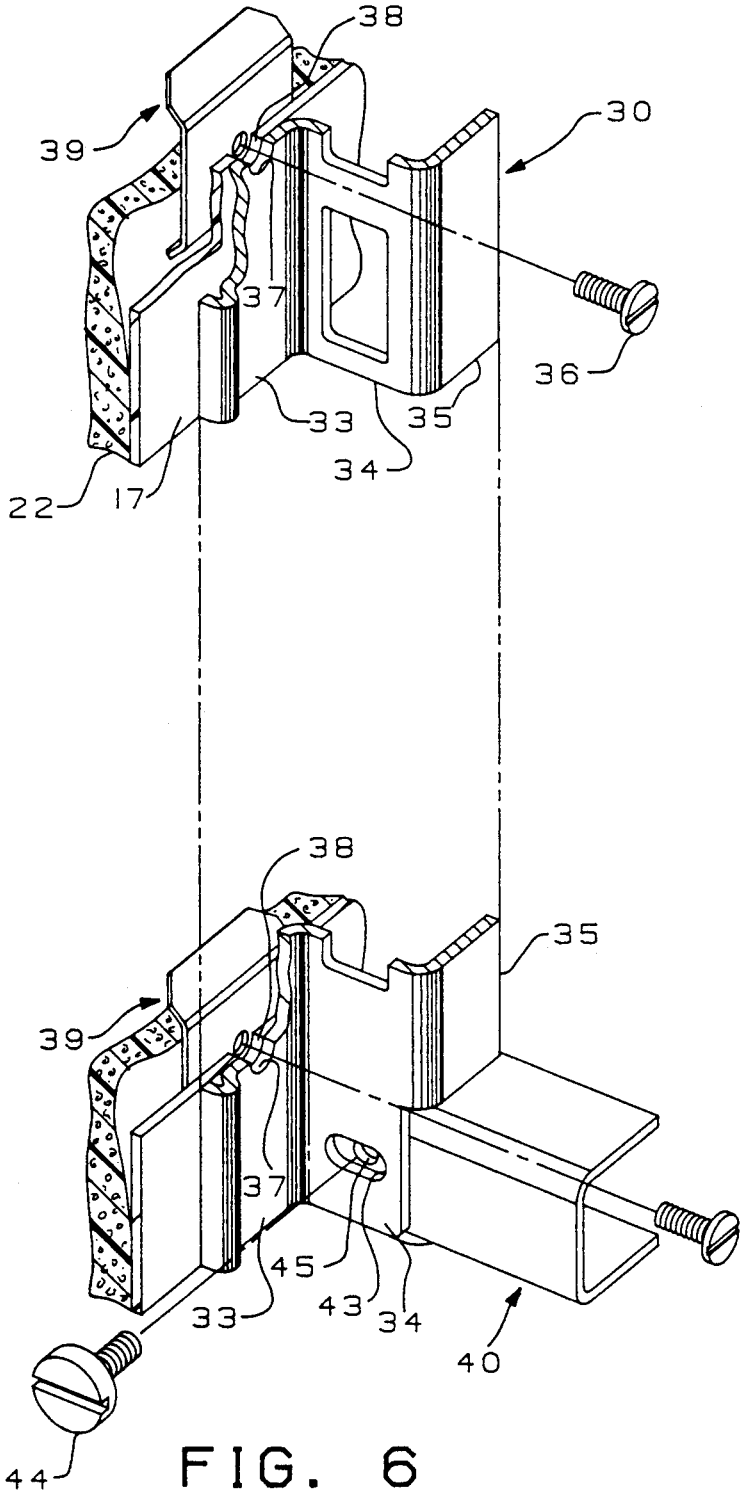
FIG. 6 is an enlarged fragmentary isometric view, partly in section, showing the connection of one of the side ladders of the shelf support system of FIG. 1 to an adjacent side wall of the freezer compartment.

As shown in FIG. 6, the side ladder 30 includes a first flange 33 for attachment to the side wall 17, a central portion 34, which is substantially perpendicular to the first flange 33, and a second flange 35, which is substantially perpendicular to the central portion 34 and substantially parallel to the first flange 33. The side ladder 30 is attached to the side wall 17 of the freezer compartment 11 by screw anchors 36 extending through openings 37 in the first flange 33 of the side ladder 30 adjacent its top and bottom and into corresponding aligned openings 38 in the side wall 17 of the freezer compartment 11 (see FIG. 1). Each of the screw anchors 36 (see FIG. 6) is retained in position by an anchor plate 39, which is on the exterior of the side wall 17 of the freezer compartment 11 (see FIG. 1). The foam insulation material 22 (see FIG. 6) overlies each of the anchor plates 39.

Accordingly, the side ladder 30 (see FIG. 1) is fixed to the side wall 17 of the freezer compartment 11. The side ladder 31 is similarly fixed to the side wall 18 of the freezer compartment 11.

The shelf support system 25 (see FIG. 2) includes a U-shaped horizontal bar 40 extending between the bottoms of the side ladders 30 and 31. The horizontal bar 40 is attached to the central portion 34 of the side ladder 30 and a central portion 41 of the side ladder 31. The second flange 35 of the side ladder 30 has its bottom end cut off to enable the horizontal bar 40 to fit therebeneath. Likewise, the side ladder 31 has its flange 42 cut off at its bottom end to receive the other end of the horizontal bar 40.

The central portion 34 of the side ladder 30 has an elongated slot 43 (see FIG. 6) to receive a self-tapping screw 44 for disposition in an opening 45 in the horizontal bar 40 to attach the side ladder 30 to the horizontal bar 40. A similar arrangement exists between the side ladder 31 (see FIG. 1) and the horizontal bar 40. This arrangement enables adjustment for slight variations in the width of the freezer compartment 11.

The center ladder 32 (see FIG. 2), which is U-shaped, also has its bottom end secured to the horizontal bar 40 through a projection 46 extending downwardly from its central portion 47. A self-tapping screw 48 extends through an opening (not shown) in the projection 46 of the central portion 47 of the center ladder 32 and into an opening (not shown) in the horizontal bar 40.

This arrangement aligns the bottoms of the side ladders 30 and 31 and the center ladder 32 This enables the central portion 34 of the side ladder 30, the central portion 41 of the side ladder 31, and the central portion 47 of the center ladder 32 to be in the same plane.

The U-shaped center ladder 32 has each of its side walls 49 bent inwardly at its bottom end towards the other side wall 49 to form a substantially horizontal flange or foot engaging the top of the horizontal bar 40. This prevents chipping or wearing away of paint on the horizontal bar 40 so as to avoid a possible rust problem.

Figure 5:
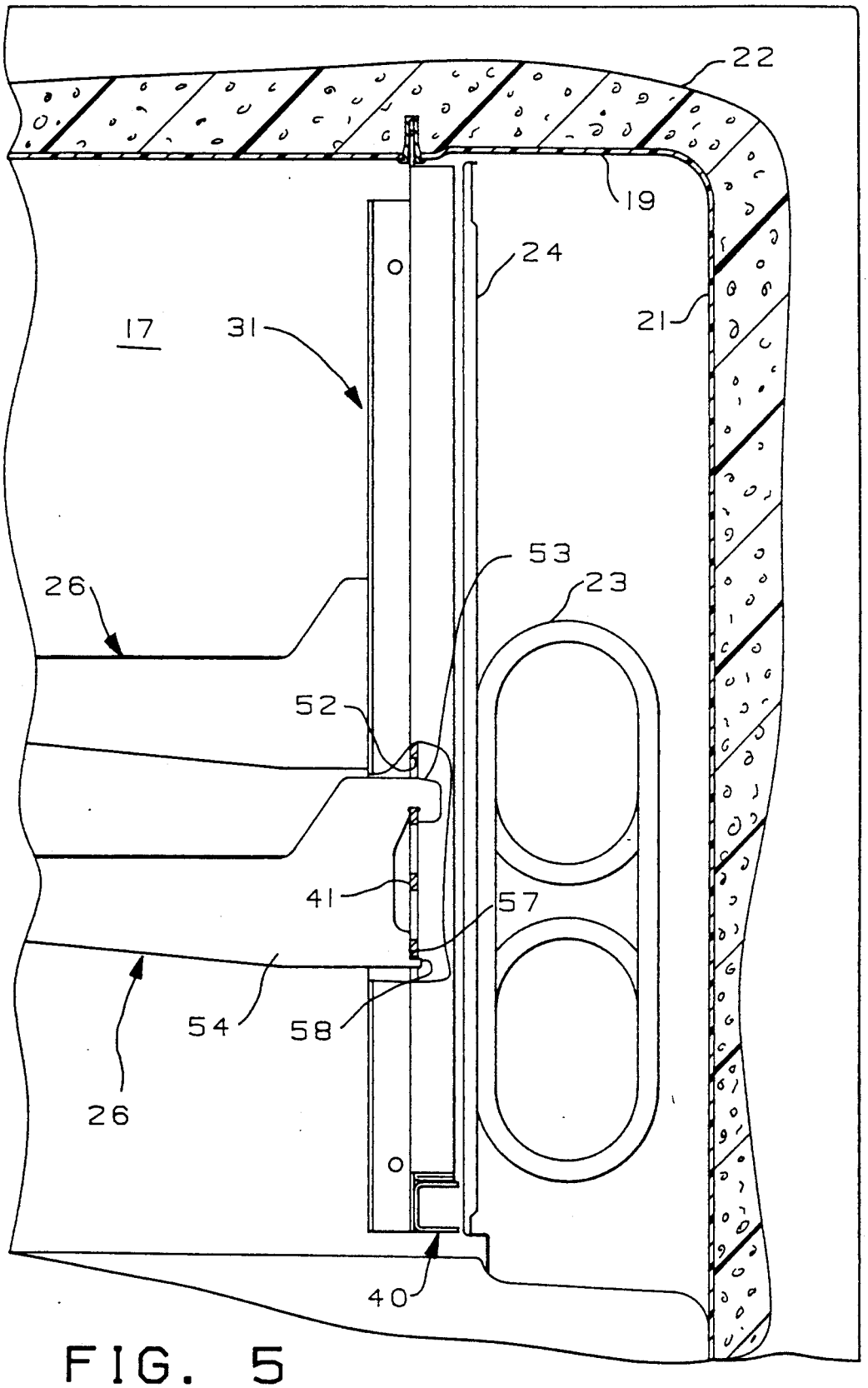
FIG. 5 is a fragmentary side elevational view, partly in section, of a portion of the freezer compartment of FIG. 1.

The central portion 34 of the side ladder 30 has a column of rectangular shaped slots or openings 50, the central portion 47 of the central ladder 32 has a column of rectangular shaped slots or openings 51, and the central portion 41 of the side ladder 31 has a column of rectangular shaped slots or openings 52. One of the split cantilever shelves 26 (see FIG. 1) is supported by the side ladder 31 and the center ladder 32 through having a hook 53 (see FIG. 5) on a side wall 54 of the shelf 26 disposed in one of the rectangular shaped slots or openings 52 in the side ladder 31 and a hook (not shown) of the same shape as the hook 53 on a side wall 56 (see FIG. 1) of the shelf 26 disposed in one of the rectangular shaped slots or openings 51 in the center ladder 32. The side wall 54 of the shelf 26 has an end portion 57 (see FIG. 5) abutting the central portion 41 of the side ladder 31 between two of the rectangular shaped slots or openings 52 in the side ladder 31 and a projection 58 extending into another of the rectangular shaped slots or openings 52 in the side ladder 31. Likewise, the side wall 56 (see FIG. 1) of the shelf 26 has an end portion (not shown) abutting the central portion 47 of the center ladder 32 between two of the rectangular shaped slots or openings 51 in the center ladder 32 and a projection (not shown) extending into another of the rectangular shaped slots or openings 51 in the center ladder 32.

The side ladder 30 and the center ladder 32 support another of the shelves 26 in the same manner as the shelf 26 is supported by the side ladder 31 and the center ladder 32. More than one of the shelves 26 may be supported between the side ladder 30 and the center ladder 32 or between the side ladder 31 and the center ladder 32, if desired.

Figure 7:
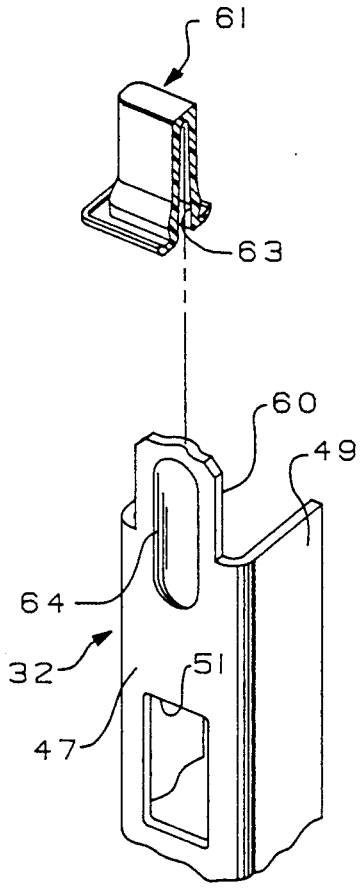
FIG. 7 is an enlarged fragmentary isometric view, partly in section, of the mounting of the center ladder in a nipple on the top wall of freezer compartment.

The center ladder 32 (see FIG. 7) has a projection 60 extending upwardly from the central portion 47 for support by the top wall 19 (see FIG. 4) of the freezer compartment 11. The top wall 19 has a molded nipple 61 disposed within an opening 62 in the top wall 19 of the freezer compartment 11. The nipple 61 is pressed into the opening 62 in the top wall 19 before the foam insulation material 22 is applied.

The nipple 61 (see FIG. 7) has a recess 63 therein to receive the projection 60 of the center ladder 32. As shown in FIG. 3, the recess 63 is slightly larger in its portion that initially receives the projection 60 of the center ladder 32. This enables easy insertion of the projection 60 into the recess 63 in the nipple 61.

It should be understood that the projection 60 is disposed within the recess 63 in the nipple 61 prior to connecting the side ladders 30 and 31 (see FIG. 1) to the side walls 17 and 18, respectively, of the freezer compartment 11. The horizontal bar 40 is attached after the side ladders 30 and 31 are secured to the side walls 17 and 18, respectively, of the freezer compartment 11.

Thus, the shelf support system 25 is supported by the side walls 17 and 18 and the top wall 19 of the freezer compartment 11. There is no support by the cover 24.

The projection 60 has an embossment 64 to increase the strength of the projection 60. The embossment 64 also reduces the possibility of the projection 60 bending due to an excess shelf load or due to shipping conditions.

Figure 8:
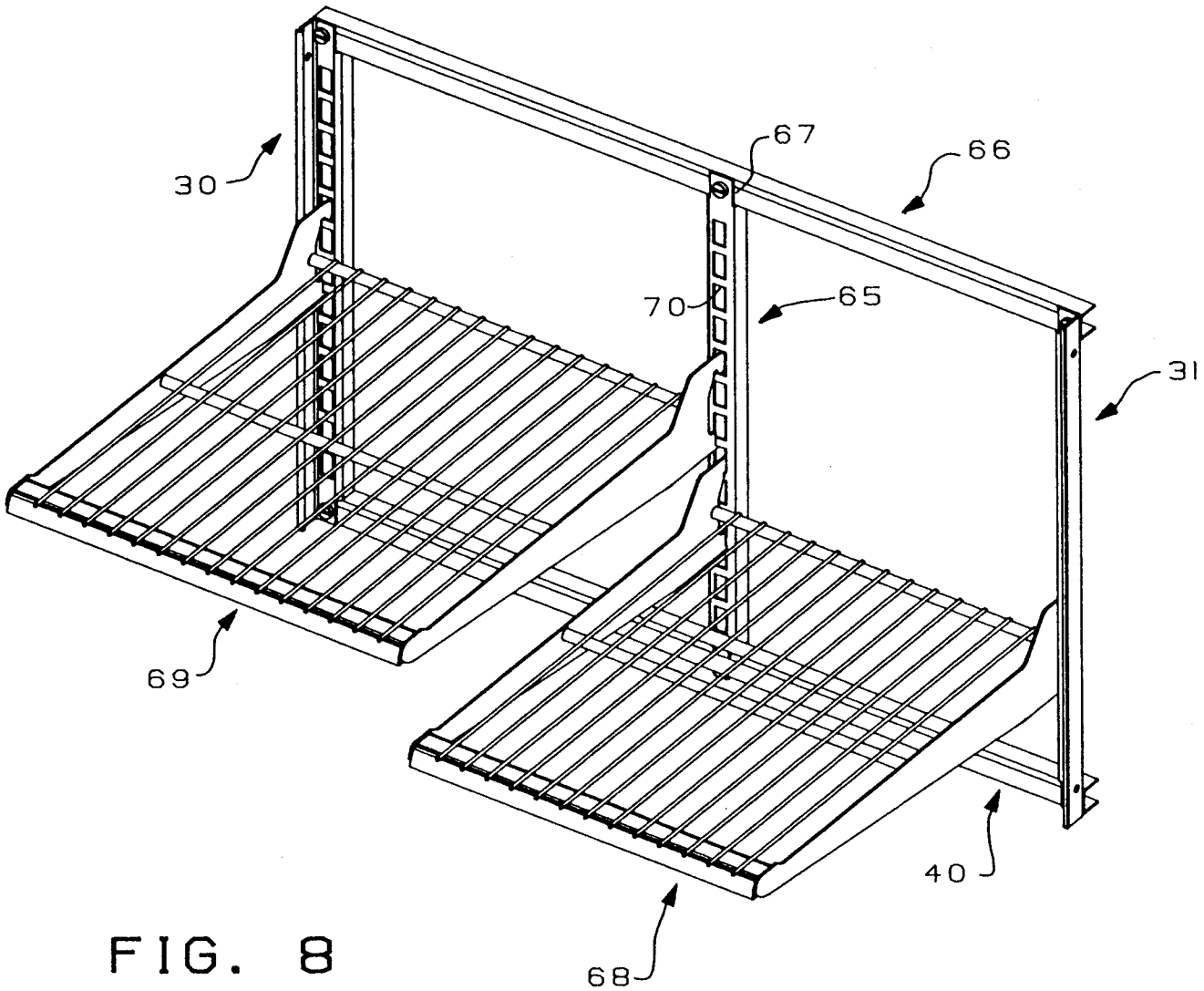
FIG. 8 is an isometric view of a modification of the shelf support system of the present invention.

Instead of using the projection 60 to support the upper end of the center ladder 32, the center ladder 32 may be replaced by a center ladder 65 (see FIG. 8), which is the same height as the side ladders 30 and 31. A U-shaped horizontal bar 66, which is substantially the same as the horizontal bar 40, extends between the side ladders 30 and 31 and is attached to the upper ends thereof and to a projection 67 on the upper end of the center ladder 65. The horizontal bar 66 would be secured in the same manner as the horizontal bar 40 is secured to the bottom of each of the side ladders 30 and 31 and the center ladder 65.

The center ladder 65 is closer to the side ladder 31 than to the side ladder 30 so that an ice maker (not shown), which would be mounted on the side wall 18 (see FIG. 1) of the freezer compartment 11, would be disposed between the center ladder 65 (see FIG. 8) and the side ladder 31 with the center ladder 65 being adjacent the inner side of the ice maker. This would result in a shelf 68 having a lesser width than a shelf 69. The shelves 68 and 69 would be formed in the same manner as the shelves 26 (see FIG. 1) except for the different widths. Thus, one or more of the shelves 68 (see FIG. 8) would be disposed beneath the ice maker (not shown).

It should be understood that the center ladder 32 (see FIG. 1) could be disposed closer to the side ladder 31 than to the side ladder 30 if an ice maker were utilized with the arrangement of FIG. 1. Likewise, it should be understood that the center ladder 65 (see FIG. 8) could be disposed the same distance from each of the side ladders 30 and 31 when there is no ice maker.

It also should be understood that each of the shelves 26 (see FIG. 1) may be supported in the same slots 51 in the center ladder 32 so that both of the shelves 26 would be in the same horizontal plane. Likewise, the center ladder 65 (see FIG. 8) could have its rectangular shaped slots 70 support one side of each of the shelves 68 and 69 in the same locations so that the shelves 68 and 69 could be in the same horizontal plane.

An advantage of this invention is that it insures that the receiving means for each of the shelves are aligned in the same plane with each other so that the shelves supported thereby are maintained horizontal. Another advantage of this invention is that it easily accommodates various width shelves when such is desired. A further advantage of this invention is that shelves of less width than the compartment may be supported. Still another advantage of this invention is that the center ladder is supported at both of its ends independently of the evaporator cover.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

We claim:

1. In a refrigerator having a freezer compartment including a top wall, a bottom wall, a rear wall, a pair of substantially parallel side walls, evaporator means disposed in the freezer compartment forward of the rear wall, and a cover disposed forward of the evaporator means, a shelf support system including:

first support means secured to one of the side walls of the freezer compartment forward of the cover;

second support means secured to the other of the side walls of the freezer compartment forward of the cover;

third support means disposed between said first support means and said second support means and forward of the cover;

each of said first support means, said second support means, and said third support means having receiving means to receive a portion of a shelf to adjustably support a shelf between said first support means and said third support means or between said second support means and said third support means;

first extending means extending between said first support means and said second support means adjacent their bottoms for supporting said third support means adjacent its bottom, said first extending means being secured to each of said first support means, said second support means, and said third support means;

and supporting means for supporting said third support means adjacent its upper end, said supporting means being supported by at least one of the walls of the freezer compartment.

2. The shelf support system according to claim 1 in which said supporting means includes second extending means extending between said first support means and said second support means adjacent their upper ends, said second extending means being secured to said third support means adjacent its upper end and to said first support means and said second support means adjacent their upper ends.

3. The shelf support system according to claim 2 in which said first extending means includes a substantially horizontal bar.

4. The shelf support system according to claim 3 in which said second extending means includes a substantially horizontal bar.

5. The shelf support system according to claim 2 in which said second extending means includes a substantially horizontal bar.

6. The shelf support system according to claim 2 including:

each of said first support means, said second support means, and said third support means having a substantially vertical planar portion in which said receiving means is disposed;

and said first extending means maintaining said substantially vertical planar portions of said first support means, said second support means, and said third support means in substantially the same vertical plane.

7. The shelf support system according to claim 6 in which said receiving means in each of said first support means, said second support means, and said third support means includes a plurality of vertically spaced openings arranged in a column in said substantially vertical planar portion.

8. The shelf support system according to claim 1 in which said supporting means includes cooperating means supported by the top of said third support means and the top wall of the freezer compartment.

9. The shelf support system according to claim 8 in which said first extending means includes a substantially horizontal bar.

10. The shelf support system according to claim 8 including each of said first support means, said second support means, and said third support means having a substantially vertical planar portion in which said receiving means is disposed;

and said first extending means maintaining said substantially vertical planar portions of said first support means, said second support means, and said third support means in substantially the same vertical plane.

11. The shelf support system according to claim 10 in which said receiving means in each of said first support means, said second support means, and said third support means includes a plurality of vertically spaced openings arranged in a column in said substantially vertical planar portion.

12. The shelf support system according to claim 1 in which said supporting means includes:

a projection extending upwardly from said third support means;

and means supported adjacent the top wall of the freezer compartment to receive said projection extending upwardly from said third support means.

13. The shelf support system according to claim 12 in which said first extending means includes a substantially horizontal bar.

14. The shelf support system according to claim 12 including:

each of said first support means, said second support means, and said third support means having a substantially vertical planar portion in which said receiving means is disposed;

and said first extending means maintaining said substantially vertical planar portions of said first support means, said second support means, and said third support means in substantially the same vertical plane.

15. The shelf support system according to claim 14 in which said receiving means in each of said first support means, said second support means, and said third support means includes a plurality of vertically spaced openings arranged in a column in said substantially vertical planar portion.

16. The shelf support system according to claim 1 in which said first extending means includes a substantially horizontal bar.

17. The shelf support system according to claim 1 including:

each of said first support means, said second support means, and said third support means having a substantially vertical planar portion in which said receiving means is disposed;

and said first extending means maintaining said substantially vertical planar portions of said first support means, said second support means, and said third support means in substantially the same vertical plane.

18. The shelf support system according to claim 17 in which said receiving means in each of said first support means, said second support means, and said third support means includes a plurality of vertically spaced openings arranged in a column in said substantially vertical planar portion.

19. In a refrigerator having a freezer compartment including a top wall, a bottom wall, a rear wall, a pair of substantially parallel side walls, evaporator means disposed in the freezer compartment forward of the rear wall, and a cover disposed forward of the evaporator means, a shelf support system including:

first support means secured to one of the side walls of the freezer compartment forward of the cover;

second support means secured to the other of the side walls of the freezer compartment forward of the cover;

third support means disposed between said first support means and said second support means and forward of the cover;

each of said first support means, said second support means, and said third support means having receiving means to receive a portion of a shelf to adjustably support a shelf between said first support means and said third support means or between said second support means and said third support means;

first extending means extending between said first support means and said second support means adjacent their bottoms for supporting said third support means adjacent its bottom, said first extending means being secured to each of said first support means, said second support means, and said third support means;

supporting means for supporting said third support means adjacent its upper end;

and said supporting means including:

a projection extending upwardly from said third support means;

and recess means supported adjacent the top wall of the freezer compartment to receive said projection extending upwardly from said third support means.

20. The shelf support system according to claim 19 in which said first extending means includes a substantially horizontal bar.

* * * * *